United States Patent [19]

Rose

[11] 4,268,728

[45] May 19, 1981

[54] SWITCH ENCODER

[75] Inventor: William H. Rose, Harrisburg, Pa.

[73] Assignee: AMP Incorporated, Harrisburg, Pa.

[21] Appl. No.: 32,190

[22] Filed: Apr. 23, 1979

[51] Int. Cl.[3] ..... H01H 15/00

[52] U.S. Cl. ..... 200/16 R; 200/16 D; 200/291

[58] Field of Search ..... 200/16 C, 16 D, 16 R, 200/291, 303

[56] References Cited

U.S. PATENT DOCUMENTS 2,908,827 10/1959 Hickman ..... 307/10 R
3,999,287 12/1976 Lockard ..... 29/622
4,012,608 3/1977 Lockard ..... 200/16 D
4,152,565 5/1979 Rose ..... 200/291

*Primary Examiner*—J. V. Truhe
*Assistant Examiner*—Morris Ginsburg
*Attorney, Agent, or Firm*—Gerald K. Kita; Jay L. Seitchik

[57] ABSTRACT

A nine position circuit board mounted switch is disclosed for encoding the frequency output of a remote transmitter. Each switch position includes a manual selector set to provide a voltage output selected from two available voltage levels. The nine positions thereby provide an encoded output selected from three to the ninth power possibilities.

3 Claims, 5 Drawing Figures

SWITCH ENCODER

FIELD OF THE INVENTION

The present invention relates to miniature, circuit board mounted switches having manually operated selectors, and more particularly, to a switch having nine manually set actuators providing an encoding signal having three raised to the ninth power combinations obtained from only two different input voltages.

BACKGROUND OF THE INVENTION

In excess of twenty million devices for opening garage doors are sold annually. In the typical device, a flexible cable secured to a door is wound up on a motor driven reel. The motor is activated by a signal transmitted through space from a remote, hand-held transmitter. To prevent unauthorized entry, the transmitter output frequency is selected from a number of possibilities. The invention provides a relatively simple structure to provide a large number of frequency possibilities originating from only two input voltage levels.

SUMMARY OF THE INVENTION

The present invention provides a manually actuated switch having nine positions, each with an output terminal providing a separate encoding signal for tuning the frequency output of a remote transmitter. Each terminal is aligned with a pair of power bus contacts. Each power bus contact includes a signle terminal for pluggable connection in a circuit board over which a voltage is supplied. A manually actuated selector is provided for each output terminal, and is set manually to one of three positions. In a first position, the selector electrically connects an output terminal to a first bus contact. In a second position, the selector prevents the connection of a terminal to either of the bus contacts. In a third position, the selector connects an output terminal to a second bus contact. As a result, the voltage level of each output terminal has three possibilities, a first, equal to the voltage level of the first bus contact, a second, equal to zero, and a third, equal to the voltage level of the second bus contact. In a preferred embodiment, the switch includes nine output terminals. The number of combinations of voltages supplied by nine output terminals is equal to three, raised to the ninth power. The invention, thereby, provides a relatively simple structure which is manually set with ease to provide a large number of encoding possibilities from only two input voltage levels.

OBJECTS

An object of the present invention is to provide a simple switch structure which is quickly set to provide a large number of encoding possibilities from only two input voltage levels.

Another object of the present invention is to provide a miniature printed circuit board mounted switch having sliders which are manually set to provide an encoding signal selected from a large number of possibilities and requiring only two input voltage levels.

Further objects and many advantages of the present invention will become apparent from the following detailed description taken in conjunction with the drawings.

DRAWINGS

DETAILED DESCRIPTION

Figure 1:
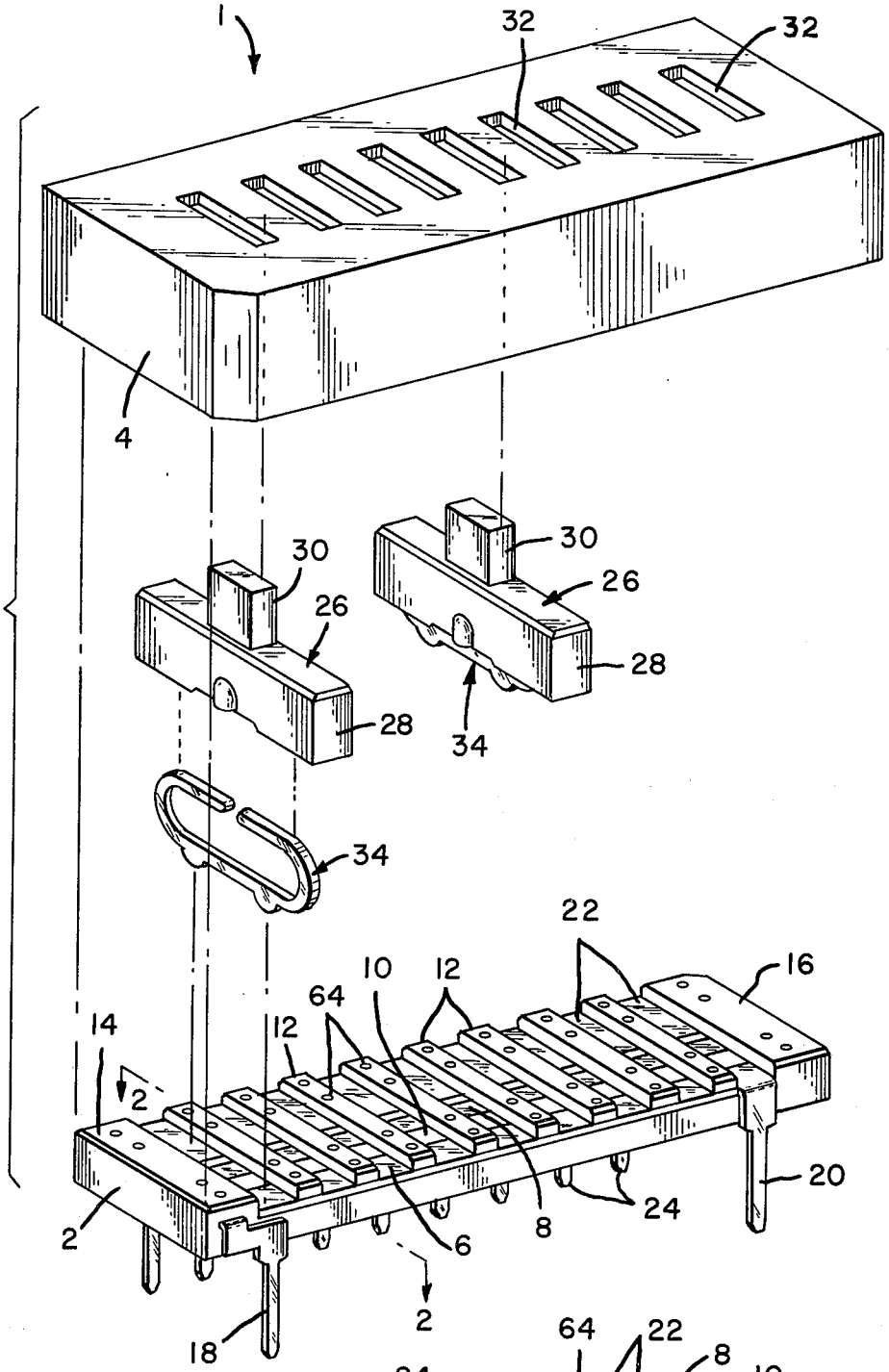
FIG. 1 is an enlarged perspective of a switch according to the present invention with parts in exploded configuration.
Figure 2:
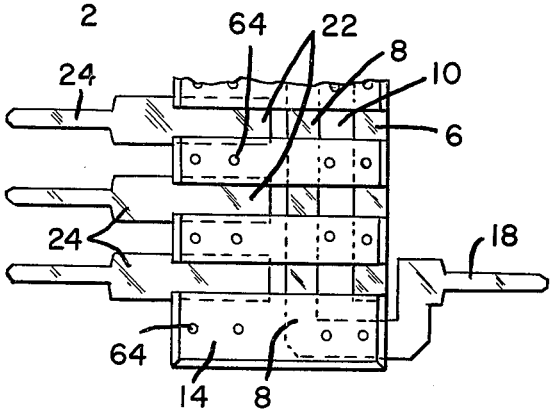
FIG. 2 is an enlarged fragmentary plan of a portion of the switch illustrated in FIG. 1.

With more particular reference to FIG. 1, there is shown generally at 1 a switch according to the present invention having a base 2 and a cover 4. The base 2 is fabricated by molding a suitable, rigid when cured, plastic material. An elongated metal strip bus contact 6 is parallel with a second metal strip bus contact 8. Both bus contacts are coplanar with a surface 10 of the base 2, and are molded in place. A plurality of parallel, spaced apart partitions 12, project upwardly from the plane of the contacts 6 and 8 and the surface 10, and are molded integral with the remainder of the base 2. End partitions 14 and 16, similar to the partitions 12, are molded integral with the base 2. An electrical terminal 18 integral with the contact 8, projects outwardly from a side of the partition 14 and is bent out of the plane of the contact 8 to provide a depending electrical terminal. Similiarly, a terminal 20 integral with the bus contact 6 projects through a side of the base 2 and is bent out of the plane of the remainder of the contact 6 to provide a depending electrical terminal. A plurality of additional contacts or terminals 22 of metal strip are exposed between corresponding partitions 12, 14 and 16. Each terminal 22 is coplanar with the contacts 6 and 8 and with the surface 10. Portions 24 of the terminals 22 project outwardly from the base 2 and are bent out of the plane of the remainder of the contacts 22 thereby to provide depending electrical terminals.

Figure 3:
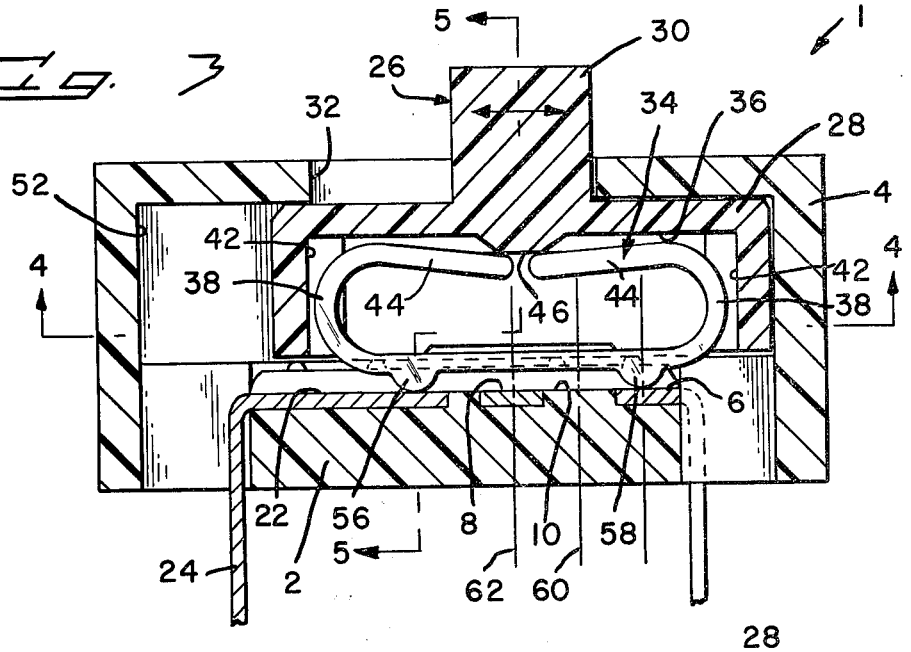
FIG. 3 is an enlarged elevation in section of the switch shown in FIG. 1 with the parts fully assembled.
Figure 4:
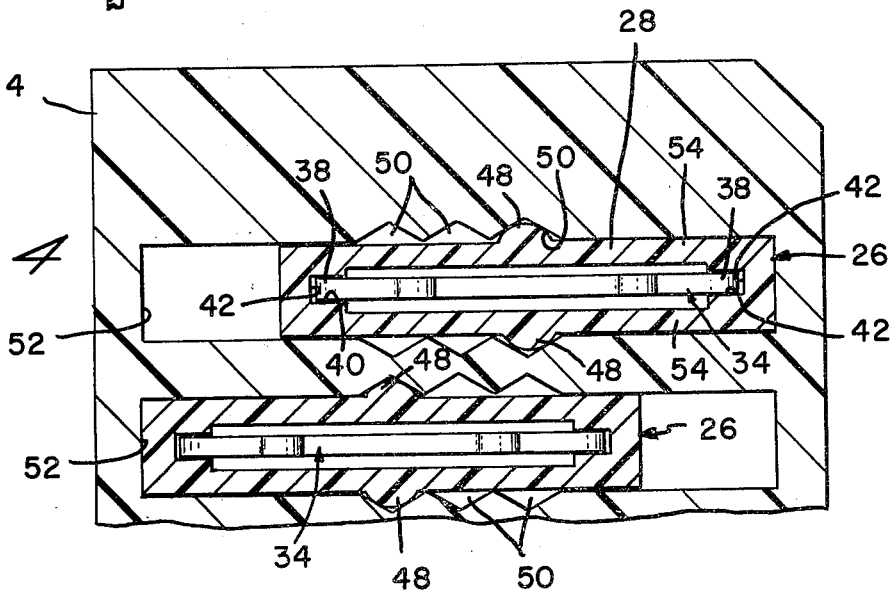
FIG. 4 is a fragmentary section taken along the line 4—4 of FIG. 3.
Figure 5:
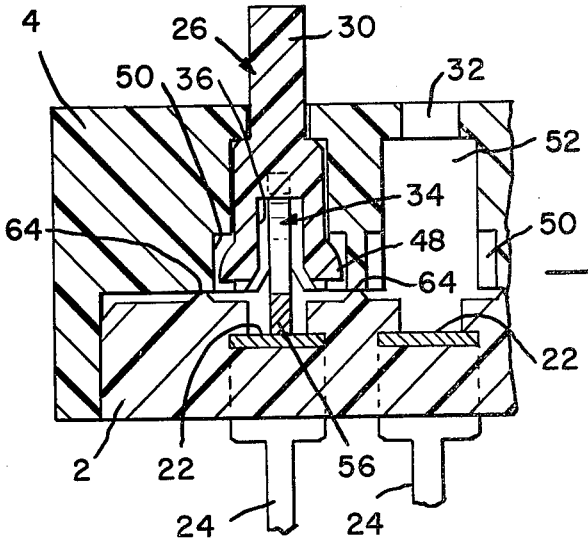
FIG. 5 is an enlarged fragmentary section taken along the line 5—5 of FIG. 3.

FIGS. 1 and 3 more particularly illustrate one of many sliders 26 corresponding in number with the contacts 22. Each slider includes a molded dielectric housing 28 with an integral projecting knob 30 slideably traversible along a corresponding elongated slot 32 in the cover 4. A bridging contact 34 is received in an inverted recess 36 of each slider housing 28. Each contact 34 includes a metal strip stamped transversely of its thickness to form end loop portions 38. As shown in FIGS. 3 and 4, each loop portion 38 has its thickness frictionally retained between sidewalls of a slotted portion 40 of a corresponding recess 36. An end wall 42 of each slotted portion 40 is spaced from a corresponding loop portion 38 to permit outward displacement of the same in response to resilient deflection of the contact 34. Free ends 44 of each bridging contact 34 are generally coplanar and engage a projection 46 of each housing 28. FIG. 3 shows the contact portions 44 being slightly spaced from the top wall of the housing 28 and flexed slightly when the loop portions are under load between the projection 46 and the contacts 22 or 6 or the surface 10.

FIG. 4 illustrates each housing 28 having integral rounded projections 48 on opposite sides thereof. Each projection registers within one of a corresponding series of three detents 50 provided in cover 4 and communicating with a corresponding elongated channel 52 receiving a corresponding housing 28. As each housing 28 slideably traverses along a channel 52 the projections 48 will register in turn with each detent 50. The sides 54 of each housing 28 will flex resiliently toward and away from each other to allow passage of the projections 48 from one detent to another.

FIG. 3 illustrates each bridging contact 34 having an integral arcuate projection 56 or 58 adjacent a corresponding loop portion 38. One projection 56 slidably engages a contact 22. The other 58 engages the contact 6 when the carriage 26 is in a first detented position. Upon shifting of the carriage from right to left in FIG. 3 to a second detented position, the projection 58 will be located at a center line 60 engaging the surface 10. Further shifting of the carriage from right to left, to a third detented position, will cause the projection 58 to be located along a center line 62 in engagement with the contact 8. In each of the three detented positions, the projection 56 will be engaged with the contact 22. The cover 4 is supported on projecting lugs 64 which can be sized in height to insure proper spacing of the housing and sliders in respect to the base.

In use, the terminals 18, 20 and 24 are pluggably connected to a circuit board. A voltage signal is supplied over plated paths of the circuit board to each of the terminals 18 and 20. In a first detented position of the carriage, as shown in FIG. 3, the voltage supplied to terminal 20 will appear at contact 6, through the bridging contact 34 and to the output terminal 24. In a second detented position, no voltage is supplied to the output terminal 24 since the projection 58 engages the surface 10. In a third detented position, with the projection 58 engaging the contact 8, a voltage supplied to the terminal 18 will be supplied also along the contact 8, through the bridging contact 34 and to the terminal 24. Thus, each terminal 24 may be selected to provide an output voltage having one of three different levels as determined by manually positioning the selector 26.

Although a preferred embodiment of the present invention is disclosed in detail, other embodiments and modifications which would be apparent to one having ordinary skill in the art are intended to be covered by the spirit and scope of the claims.

What is claimed is:

1. In a switch having a base and a cover cooperating to contain plural sliders each comprising a carriage and a resilient contact moveable with said carriage to bridge either a first bus contact or a second bus contact, or neither, with a third bus contact, the improvement comprising:

each said resilient contact includes a metal strip having its thickness in a linear plane and formed with open loop portions frictionally retained across said thickness in a slotted recess defined between flexible walls of a respective said carriage, said loop portions having free ends opposing each other and impinging against said carriage, said loop portions being integrally joined remote from said free ends and provided with a projecting first portion slidably impinged on said third bus contact, and a second projecting portion impinged alternately in turn on said first and second bus contacts and an insulation portion of said base, said flexible walls being biased toward and away from each other upon movement between and registration within a series of detents along a slotted opening of said cover, and means on each said carriage flexing said free ends toward said first and second projecting portions.

2. The structure as recited in claim 1, wherein, said base includes lugs sized in height and supporting said cover thereon.

3. The structure as recited in claim 1, wherein, said means includes a projection impinging said free ends of said loop portions.

* * * * *